United States Patent [19]

Jabs et al.

[11] 4,404,251

[45] Sep. 13, 1983

[54] COPYING SYSTEMS, A PROCESS FOR THEIR PRODUCTION, AND SUITABLE PRINTING INKS FOR BOTH OFFSET AND BOOK PRINTING

[75] Inventors: Gert Jabs, Odenthal; Manfred Dahm, Levenkusen; Artur Haus, Overath; Ulrich Nehen, Leverkusen; Klaus Rath, Leverkusen; Norbert Weimann, Leverkusen, all of Fed. Rep. of Germany

[73] Assignee: Bayer Aktiengesellschaft, Leverkusen, Fed. Rep. of Germany

[21] Appl. No.: 352,038

[22] Filed: Feb. 24, 1982

Related U.S. Application Data

[63] Continuation-in-part of Ser. No. 244,616, Mar. 17, 1981, abandoned.

[30] Foreign Application Priority Data

| | | | |
|---|---|---|---|
| Mar. 26, 1980 | [DE] | Fed. Rep. of Germany | 3011708 |
| Mar. 26, 1980 | [DE] | Fed. Rep. of Germany | 3011709 |
| Feb. 4, 1981 | [DE] | Fed. Rep. of Germany | 3103816 |

[51] Int. Cl.[3] ..... B41M 3/12; B41L 1/20

[52] U.S. Cl. ..... 428/320.6; 106/21; 106/22; 106/27; 282/27.5; 427/150; 427/151; 427/152; 428/321.1; 428/321.5; 428/914

[58] Field of Search ..... 427/150–152; 106/21, 22, 27; 428/914, 320.6, 321.1, 321.5; 282/27.5

[56] References Cited

U.S. PATENT DOCUMENTS

| | | | |
|---|---|---|---|
| 4,081,188 | 3/1978 | Wescott | 427/150 |
| 4,113,282 | 9/1978 | Spatz et al. | 427/150 |
| 4,142,404 | 3/1979 | Ogata et al. | 427/150 |
| 4,191,403 | 3/1980 | Dessauer et al. | 427/150 |
| 4,211,437 | 7/1980 | Myers et al. | 427/150 |
| 4,263,344 | 4/1981 | Radvan et al. | 427/150 |
| 4,268,069 | 5/1981 | Stalfo | 427/150 |

OTHER PUBLICATIONS

The Condensed Chemical Dictionary, 6th ed., Rheinhold, N.Y., pp. 40 and 41.

*Primary Examiner*—Norman Morgenstern
*Assistant Examiner*—Janyce A. Bell
*Attorney, Agent, or Firm*—Connolly and Hutz

[57] ABSTRACT

The invention relates to a pressure-sensitive, carbonless copying system and to a process for the production of pressure-sensitive, carbonless copying system wherein a non-aqueous, substantially solvent free printing ink containing micro-capsules which contain dye-precursors, is applied by wet and dry offset and book printing techniques to all or part of at least one surface of a paper substrate; and to printing inks comprising (1) binders, (2) microcapsules containing dye precursors, (3) spacers having a grain size of from 1.5 to 10 times the diameter of the microcapsules, and optionally auxiliaries and additives.

16 Claims, No Drawings

COPYING SYSTEMS, A PROCESS FOR THEIR PRODUCTION, AND SUITABLE PRINTING INKS FOR BOTH OFFSET AND BOOK PRINTING

The application is a continuation-in-part of application Ser. No. 244,616 filed Mar. 17, 1981, now abandoned.

This invention relates to a process for the production of pressure-sensitive carbonless copying systems in which a printing ink containing microcapsules which incorporate dye-precursors is applied to all or part of the surface of the paper substrate by the techniques of wet or dry offset printing and book printing;

the copying systems produced by this process;

printing inks comprising a binder, microcapsules containing dye-precursors, spacers and other auxiliaries and additives;

Reaction copying papers are known (cf. M. Gutcho, Capsule Technology and Microencapsulation, Noyes Data Corporation, 1972, pages 242–277; G. Baxter in Microencapsulation, Processes and Applications, published by J. E. Vandegaer, Plenum Press, New York, London, pages 127–143).

Reaction copying papers preferably consist of two or more sheets of paper placed loosely on top of one another, the upper sheet being coated underneath with a donor layer and the lower sheet being coated on top with a receiving layer. Accordingly, a donor layer and a receiving layer are in mutual contact. The donor layer contains microcapsules of which the core material is a solution of a dye-forming agent in an organic solvent, whilst the receiving layer contains a material which develops the dye-forming agent to form the dye. When the paper is typed on, the capsules are destroyed under the high pressures of the typewriter and the core material which flows out impinges on the receiving layer, so that a copy of the typing is formed.

The receiving layer generally contains binders and pigments, for example active absorbents, such as kaolin, attapulgite, montmorillonite, bentonite, acid fuller's earth or phenolic resins. For example, acid-activatable dyes may be used for the donor layer and acid-reacting components for the receiving layer.

A further development of these reaction copying papers are the so-called "one-component" reaction copying papers. In copying papers of this type, one side of an individual sheet of paper carries the dye precursor, generally in the form of microcapsules, and also the dye developer. If pressure is applied, for example by a typewriter or any other writing instrument, the capsule containing the dye precursor is split open and the dye precursor reacts with the dye developer surrounding it (cf. U.S. Pat. No. 2,730,456).

According to the oldest prior art, the coating of the paper substrate to produce the carbonless copying systems is generally carried out with an aqueous coating composition over the entire surface of the substrate, as described for example in German Offenlegungsschrifts Nos. 19,34,457 and 1,955,542.

The processes described above are attended by the disadvantage that, following application of the coating composition, the water is evaporated and this requires a considerable input of energy. In addition, the need for drying requires the use of a complex and expensive apparatus for continuously drying a substrate which has been coated with an aqueous coating composition. Another albeit related problem concerns removal of the polluted water which emanates from production and from the purification of the aqueous coating composition.

If volatile organic solvents are used in the production of the coatings, the excess solvent also has to be evaporated in order to dry the coating. This results in the formation of solvent vapours which are particularly dangerous.

Whole-surface coatings are not economical because, in most cases, only parts of the copying system are used.

For this reason, there are numerous known processes for partially applying coating compositions to a paper substrate. Thus, according to the prior art, aqueous or solvent-containing coatings may be applied to part of a paper substrate by rotogravure or flexoprinting (cf. for example German Offenlegungsschrift No. 2,541,001 and U.S. Pat. Nos. 3,016,308 3,914,511). These processes are also attended by the disadvantage that the coatings have to be subsequently dried. For these reasons, it was proposed, for example in U.S. Pat. Nos. 3,016,308, 3,079,351 and 3,684,549 and in German Offenlegungsschrifts Nos. 2,719,914 and 2,719,935, to take up the microcapsules in waxes and to coat the paper substrate with hot melt systems of this type.

Although these proposed measures avoid removal of the solvents, the wax-like coating changes the character of the paper because relatively large quantities of wax have to be applied.

In addition, the melt systems are applied by means of hot carbon printing machines which, although enabling printing, coating with waxes and finishing to be combined in an on-line system, always requires a separate installation for each process step.

According to this prior art, processes for printing microcapsules in coating compositions on offset printing machines or even book printing machines were regarded as unworkable because one were of the opinion that, both in the production of the printing ink and also in the distributor rollers of the printing machine and during the printing process, shearing and compressive forces would destroy most of the microcapsules.

The present invention is based on the discovery that (a) microcapsules can be incorporated into highviscous printing inks by using high shearing and compressive forces and (b) said printing inks can be applied substantially in an intact form to a paper substrate on both offset and book printing machines.

Accordingly, the present invention provides a process for the production of pressure-sensitive carbonless copying systems by applying printing inks containing a binder onto a paper substrate and subsequently hardening, said process being characterized in that a printing ink which comprises microcapsules containing dye precursors spacers having a grainsize from 1,5 to 10 times the diameter of the microcapsules, a binder having the following ingredients:

(a) air-drying alkyd resins and/or vegetable oil and optionally (b) phenolic resins, maleinic resins, both being optionally modified by rosin, modified rosin and optionally (c) mineral oil and optionally siccatives and anti-skinning agents is applied to all or part of the surface of a paper substrate by wet or dry offset or book printing techniques. The present invention also relates to the copying systems produced by the process according to the invention.

In addition, the present invention is based on the discovery that a printing ink which comprises a binder, microcapsules containing dye precursors and spacers as well as, optionally, other auxiliaries and additives can be applied to a web of paper on an offset printing or book printing machine.

The present invention also provides printing inks comprising a binder (preferably 90 to 20% by weight of the ink), microcapsules containing dye precursors (preferably 10 to 40% by weight of the ink), spacers (preferably 2 to 20% by weight of the ink), and optionally other auxiliaries and additives (up to 50% by weight of the ink). Especially the printing ink consists of 80 to 40% by weight binder, 18 to 40% by weight of microcapsules, 2 to 20% by weight spacers and up to 20% by weight of other auxiliaries and additives, the latter % being based on the composition of binder, microcapsules and spacers.

The printing inks according to the invention preferably hve viscosities of from 5 to 200 pascal, especially from 10 to 150 pascal. The microcapsules used for carrying out the process according to the invention and various processes for their production are well known. Thus, it is possible to use the long-known microcapsules obtainable by coacervation or complex coacervation from gelatin and gum arabic as well as gelatin and other inorganic and organic polyanions. Various processes of this type are known inter alia from M. Gutcho's work entitled "Capsule Technology and Microencapsulation", Noyes Data Corporation 1972.

Microcapsules of which the walls consist of polymers, polycondensation and polyaddition products are particularly suitable for use in the process according to the invention.

The following synopsis is taken from G. Baxter, Microencapsulation Processes and Applications, published by J. E. Vandegaer, and provides a summary of known capsule wall polymers:

| Crosslinked capsule Wall polymers | Reaction components for producing capsule wall polymers | |
|---|---|---|
| Polyamides $-\overset{\vert}{N}-\overset{O}{\overset{\Vert}{C}}-$ | $-\overset{\vert}{N}-H$ diamine + | $Cl-\overset{O}{\overset{\Vert}{C}}-$ dicarbonyl chlorides |
| Polyurethanes $-\overset{\vert}{N}-\overset{O}{\overset{\Vert}{C}}-O-$ | $-O-H$ bisphenol + | $O=C=N-$ diisocyanates |
| Polysulphonamides $-\overset{H}{\overset{\vert}{N}}-\overset{O}{\overset{\Vert}{S}}-$ ($\Vert$ O) | $-\overset{\vert}{N}-H$ diamine + | $Cl-\overset{O}{\overset{\Vert}{S}}-$ ($\Vert$ O) disulphonyl chlorides |
| Polyesters $-O-\overset{O}{\overset{\Vert}{C}}-$ | $-O-H$ bisphenol + | $Cl-\overset{O}{\overset{\Vert}{C}}-$ dicarbonyl chloride |
| Polycarbonates $-O-\overset{O}{\overset{\Vert}{C}}-O$ | $-O-H$ bisphenol + | $Cl-\overset{O}{\overset{\Vert}{C}}-Cl$ phosgene |

-continued

| Crosslinked capsule Wall polymers | Reaction components for producing capsule wall polymers | |
|---|---|---|
| Polysulphonates $-O-\overset{O}{\overset{\Vert}{S}}-$ ($\Vert$ O) | $-O-H$ bisphenol + | $Cl-\overset{O}{\overset{\Vert}{S}}-$ ($\Vert$ O) disulphonyl chlorides |

For the process according to the present invention also microcapsules having walls of special polyacrylates can be used, as e.g. described in German Offenlegungsschrifts Nos. 2 237 545 and 2 119 933.

Phenol-formaldehyde or urea-formaldehyde condensates may also be used as the wall material, optionally also in combination with the afore cited capsule wall polymers.

Microcapsules of which the shells consist of polyaddition products of polyisocyanate and polyamines are preferably used in the process according to the invention.

Isocyanates suitable for use in the production of microcapsules such as these are diisocyanates, such as xylylene-1,4-diisocyanate, xylylene-1,3-diisocyanate, trimethylene diisocyanate, hexamethylene diisocyanate, propylene-1,2-diisocyanate, butylene-1,2-diisocyanate, ethylidene diisocyanate, cyclo-1,2-diisocyanate, cyclohexyl-1,4-diisocyanate, polyisocyanate prepolymers, for example the addition product of hexamethylene diisocyanate and hexane triol, the addition product of 2,4-tolylene diisocyanate with pyrocatechol, the addition product of tolylene diisocyanate with hexane triol, the addition product of tolylene diisocyanate with trimethylol propane, the addition product of xylylene diisocyanate with trimethylol propane or suitable polyisocyanates analogous to the compounds previously mentioned.

Other modified aliphatic isocyanates are those based on hexamethylene-1,6-diisocyanate, m-xylylene diisocyanate, 4,4'-diisocyanato-dicyclohexyl methane and isophorone diisocyanate which contain at least two functional isocyanate groups per molecule.

Other suitable compounds are polyisocyanates based on derivatives of hexamethylene-1,6-diisocyanate having a biuret structure of which the production is known from German Auslegeschrifts Nos. 11 01 394 and 15 43 178 and from German Offenlegungsschrifts Nos. 15 68 017 and 19 31 055.

Before being used for microencapsulation, the polyisocyanates suitable for use in accordance with the invention may be additionally modified by reaction with difunctional and trifunctional chain extenders, for example water, with polyfunctional alcohols, such as ethane diol, glycerol or trimethylol propane, or carboxylic acids such as succinic acid, adipic acid, sebacic acid, in quantities of from 0.01 to 0.5 mole per isocyanate equivalent.

Instead of the isocyanate groups, carbodiimide, uret dione, uretone imine, uretidine dione diimine, 4-imino-oxazolidinone-(2)-, $\beta$-alkylene-propiolactone and cyclo-1,3-butane dione groups may also be present as reactive groups.

Thus, it is possible, for example, to use polyisocyanatopolyuretone imines, of the type obtained by subjecting hexamethylene-1,6-diisocyanate containing biuret groups to carbodiimide formation in the presence of organophosphorus catalysts and by the further reaction of carbodiimide groups initially formed with isocyanate groups to form uretone imine groups. In addition, these isocyanates may be used in admixture with one another and other aliphatic and aromatic isocyanates.

Depending on the reaction conditions, the resulting modified polyisocyanate may contain considerable proportions of oxadiazine trione, triisocyanurate or sym. Triazine dione imine as structural elements. Products such as these are also suitable for use as shell formers.

Diisocyanates corresponding to formula (I) below are particularly suitable:

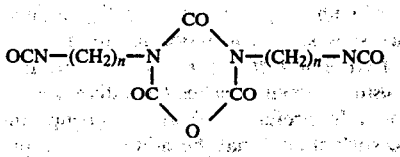

(I)

Diamines suitable for reaction with the above-mentioned isocyanates are aliphatic primary or secondary di- and polyamines, e.g., 1,2-ethylene diamine, bis-(3-aminopropyl)-amine, hydrazine, hydrazine-2-ethanol, bis-(2-methylaminoethyl)-methyl amine, 1,4-diaminocyclohexane, 3-amino-1-methylaminopropane, N-hydroxy ethyl ethylene diamine, N-methyl-bis-(3-aminopropyl)-amine, 1,4-diamino-n-butane, 1,6-diamino-n-hexane, ethylene-(1,2)-diamine-N-ethyl sulphonic acid (alkali salt), N-aminoethyl-1,2-ethylene diamine (diethylene triamine), bis-(N,N'-aminoethyl)-1,2-ethylene diamine (triethylene tetramine). Hydrazine and its salts are also regarded as diamines in the present context.

Examples of the dye forming compounds are triphenyl methane compounds, diphenyl methane compounds, xanthene compounds, thiazine compounds, spiropyran compounds or the like.

The following are examples of the groups mentioned above:

Examples of a triphenyl methane compound are 3,3-bis-(p-dimethylaminophenyl)-6-dimethylaminophthalide (i.e. crystal violet lactone, hereinafter referred to as C.V.L.) and 3,3-bis-(p-dimethylaminophenyl)-phthalide (i.e. malachite green lactone).

Examples of a diphenyl methane compound are 4,4'-bis-dimethylamino-benzhydryl benzyl ether, N-halogen phenyl leucolamine, N-β-naphthyl leucolamine, N-2,4,5-trichlorophenyl leucolamine, N-2,4-dichlorophenyl leucolamine and the like.

Examples of a xanthene compound are rhodamine-β-anilinolactam, rhodamine-β-(p-nitroaniline)-lactam, rhodamine-β-(p-chloroaniline)-lactam, 7-dimethylamine-2-methoxy fluorane, 7-diethylamine-3-methoxy fluorane, 7-diethylamine-3-methyl fluorane, 7-diethylamine-3-chlorofluorane, 7-diethylamine-3-chloro-2-methyl fluorane, 7-diethylamine-2,4-dimethyl fluorane, 7-diethylamine-2,3-dimethyl fluorane, 7-diethylamine-(3-acetyl methylamine)-fluorane, 7-diethylamine-3-methyl fluorane, 3,7-diethylamine fluorane, 7-diethylamino-3-(dibenzylamine)-fluorane, 7-diethylamine-3-(ethylbenzylamine)-fluorane, 7-diethylamine-3-(chloroethylmethylamino)-fluorane, 7-diethylamine-3-(dichloroethylamine)-fluorane, 7-diethylamine-3-(diethylamine)-fluorane and the like.

Examples of a thiazine compound are N-benzoyl leucomethylene blue, o-chlorobenzoyl leucomethylene blue p-nitrobenzoyl leucomethylene blue and the like.

Examples of a spiro compound are 3-methyl-2,2'-spiro-bis-(benzo(f)-chromene) and the like.

Solvents which dissolve these di-forming compounds are, for example, chlorinated diphenyl, chlorinated paraffin, cottonseed oil, peanut oil, silicone oil, phthalate esters, phosphate esters, sulphonate esters, monochlorobenzene, also partly hydrogenated terphenyls, alkylated diphenyls, alkylated naphthalenes, aryl ethers, aryl alkyl ethers, higher-alkylated benzene and others which may be used either individually or in combination.

Diluents, for example, kerosene, n-paraffins, isoparaffins, are frequently added to the solvents.

To produce the microcapsules by the polyaddition process, the colour-forming compounds and the isocyanate are first dissolved in one of the above-mentioned solvents and the resulting organic phase is emulsified in the continuous aqueous phase which may contain protective colloid and, optionally, emulsifiers. An aqueous polyamine solution is then added to the emulsion in a stoichiometric quantity to the polyisocyanate in the organic phase.

For emulsification and stabilisation of the emulsion formed, protective colloids and emulsification aids are added to the aqueous phase. Examples of products such as these acting as protective colloids are carboxy methyl cellulose, gelatin and polyvinyl alcohol.

Examples of emulsifiers are ethoxylated 3-benzyl hydroxy biphenyl, reaction products of nonyl phenyl with different quantities of ethylene oxide and sorbitan fatty acid esters.

The microcapsules may be produced either continuously or in batches. Dispersion units of the type which generate a shear gradient are generally used. Examples of dispersion units such as these are paddle, rotor-cage and high-speed stirrers, colloid mills, homogenisers, ultrasonic dispersers, jets, steel jets and Supraton machines. The intensity of the turbulence generated during mixing is the main determining factor for the diameter of the microcapsules obtained. Capsules ranging from 1 to 2000 μm in diameter can be produced, while capsules ranging from 2 to 20 μm in diameter are preferred. The capsules do not agglomerate and have a narrow particle size distribution. The ratio by weight of core material to shell material is 50-90 to 50-10.

For application to the paper substrate by the process according to the invention, the microcapsules are taken up in suitable resin-like binders and formulated into a printing ink suitable for either wet or dry offset printing and for book-printing.

To this end, it is possible for example to stir the aqueous microcapsule dispersions into the binder and subsequently to remove the water in vacuo. Processes of this type are also used for incorporating pigments in printing pastes (so-called flushing processes).

In another process for example, the aqueous capsule dispersions are converted by spray drying into agglomerate-free capsule powders which are then worked into the printing inks by known methods.

The spray drying of microcapsules is also known. Further known drying techniques can also be used for production of capsule powders.

The microcapsule powders are incorporated by the process according to the invention into binders which are used in known manner for the production of a printing ink suitable for use in wet or dry offset and book printing.

The printing inks according to the invention are based on a binder as follows:

(a) air-drying alkyd resins such as alkyd-resins modified by isophthalic and/or terephthalic acids, modified by natural oils such as linseed oil, soybean oil, modified by linolic and/or linolenic acids and/or vegetable oil such as linseed oil, standoil soybean oil, wood oil and optionally (b) phenol resins, maleinic resins, both of them optionally modified by rosin, preferably having acid numbers below 50, modified rosin such as polymerized or hydrogenated rosin, rosinesters and salts as Ca-, Zn-, Mg-resinates, and optionally (c) mineral oils such as paraffins, isoparaffins, aromatic hydrocarbons all having a boiling point above 180° C.

Preferably compound (b) can be used in amounts of 0–11, and compound (c) in amounts of 0–18 relating to the amount of component (a), all being amounts of weight.

The binder combination can be preferably obtained by mixing components (a) and (c) under heating and subsequently adding component (a).

Further binder components are described i.a. in "Lackrohstofftabellen" by E. Karsten 6th Edition 1976, Curt R. Vincentz Verlag, Hannover, and in "Printing and Lithio Inks" by Herbert Jay Wolfe, 6th Edition 1967 McNair Donald Company, New York City.

Present-day binders for printing inks have to satisfy various requirements. A binder for printing and offset printing inks is required to have inter alia the following properties:

1. Adequate compatibility with standard lithographic oils and mineral oil, even at room temperature, and substantial compatibility with other binders, hard resins or resin/oil concentrates.

2. A high wetting capacity for the microcapsules to simply the grinding process.

3. A high uptake capacity for the microcapsules to obtain high-definition copies.

4. Short drying times.

5. Ability to impart a high degree of gloss.

6. Entirely adequate bond strength and abrasion resistance on paper, plastic films and metal foils.

7. Good flow properties which, in conjunction with those of the microcapsules, guarantee satisfactory flow of the printing ink in the machine and prevent splashing of the printing ink, even in high-speed machines. Even this brief list is sufficient to show that one binder can hardly combine all the required properties on its own so that combinations of binders are generally used.

In addition, printing inks and offset printing inks contain small quantities of various auxiliaries, for example siccatives and anti-skinning agents, as well as printing oils and printing pastes (cf. W. Wacenski in "Der Polygraph" No. 12, 1980, p. 1016–1021).

Siccatives (=drying accelerators) are oil-soluble and petrol-soluble metal compounds primarily of cobalt, lead and manganese with organic acids, such as fatty acids, resinic acid or naphthenic acid.

Depending on the content of drying constituents (oils, alkyl resins, urethane-alkyl types) in the printing ink, it is possible to use small quantities of siccatives (around 2%) to shorten the drying time of the printing ink. Excessive quantities can give rise to overly hard drying of the printing ink (numerous difficulties arise, particularly where several colours are printed on top of one another) or may even retard the drying process.

Anti-skinning agents are intended to prevent the printing and offset printing inks from drying in the can or on the rolls of the printing machine, for example where the machine comes to a temporary stop. Anti-skinning agents are volatile (oximic) or involatile (phenolic) in character. They have an opposite effect to the siccatives. They too are added to the printing ink only in small quantities (1 to 5%). Printing auxiliaries, such as printing oils or printing pastes, enable the capsule-containing coating composition to be further adapted to the prevailing processing conditions.

Printing oil, a mixture of spindle oil (mineral oil) and linseed oil, reduces the consistency of the composition and improves its distribution. Printing pastes make the dye "shorter". These pastes are usually obtained by melting waxes, vaseline or wool fat in mineral oils. They do not have any drying properties and are completely opposite to drying pastes (siccatives).

Dispersion aids, preferably from the group comprising cationic surfactants, may be added to the printing ink to prevent the microcapsules from agglomerating.

In a preferred embodiment of the invention, in order to prevent the microcapsules from being destroyed during grinding of the printing ink and during the printing process itself, so-called spacers are added in quantities of from 10 to 30% by weight, based on the quantity of microcapsules. According to the prior art, these spacers are also used in the production of conventional carbonless copying papers. They consist either of cellulose fibre particles or starch granules preferably from 1.5 to 2 times larger in diameter than the microcapsules.

Other suitable additives are, for example, pigments and auxiliaries which favourably affect the opacity of the coating. The quantity of microcapsules worked into the binder formulation is governed by the requirements which the final printing ink has to satisfy. In the process according to the invention, the quantity of capsules is pitched as high as is acceptable taking the flow properties and "speed" of the final printing ink into account, in order on the other hand to apply an optimal quantity of microcapsules with as light a coating as possible.

The printing ink may be prepared for example by initially introducing the binder and subsequently introducing the capsules and other additives by means of a planetary mixer.

Also as already mentioned, a generally known process for the production of printing inks is to incorporate aqueous capsule dispersions by stirring in the binder formulation and, subsequently, to have the water evaporated in vacuo (flushing process). The printing ink thus prepared is then ground in several passages on a 3-roll mill. The printing ink thus prepared may be used in wet or dry offset printing processes carried our in standard offset machines.

Wet offset printing—or often called offset printing only—is the classic litho-printing method in which printing and non-printing areas are at almost the same level. Printing is enabled by the mutually pushing off of both fat and water. The printing spots are prepared in such a way that they push off the water and thereby accept the oleophilic printing ink, while the non-printing spots are made hydrophilic and consequently push off the printing ink.

Offset printing machines are, therefore, provided with dye and wet roller systems by which the printing plate fastened on a plate cylinder is wetted and the printing image is brought onto the paper substrate by means of a rubber cylinder.

In the case of dry offset printing, the same printing machine is used, however, one works without wetting systems. Therefore, this printing method is frequently also called indirect book printing.

In the working methods it is still distinghuished between sheet and roller offset printing. While in sheet offset printing cut paper sheets are printed, in roller offset printing is printed onto continuous paper rolls.

Therefore, offset printing is generally known prior art and suitable printing machines by which the process according to the invention can be carried out, are commercially widely used.

A particular advantage of the process according to the invention is that printing may be carried out and the copying paper according to the invention produced in a single operation using multicolor offset printing machines of the type in question.

The binder formulation can also be used on commercially available book printing machines.

Therefore, book printing is prior art and printing machines suitable for carrying out the process according to the invention are commercially used.

To speed up and improve drying of the papers thus produced, it is possible to integrate into the printing machines additional units, for example, hot air fans, which rapidly dry off the coatings.

Another particular advantage of the process according to the invention is that the paper substrate does not have to satisfy any particular requirements. The paper substrates used may be, for example, standard commercial CF-papers which have already been coated on top with a dye developer and which may be printed underneath with the printing inks according to the invention.

However, it is also possible to use normal uncoated papers and to apply the developer composition as well in the printing machine.

In one particular embodiment of the invention, the dye-developing substances may be directly incorporated in the capsule-containing printing inks.

By applying printing inks which contain both microcapsules containing dye precursors and color developers to the upper surface of the web-form paper substrate, it is possible to produce so-called one-component reaction papers.

Dye-developing substances are known. They are generally acid clays, such as montmorillonites, bentonites and smectitites, or phenol compounds.

The invention is further illustrated by the following Examples:

EXAMPLE 1

A printing ink was prepared as follows:

200 g of microcapsule powder were stirred into 440 g of a binder which consists of 440 g of binder which consists of 20% by weight longoil alkyd resin based on linseed oil having a high viscosity (Alkydal® L67 BAYER AG) 40% by weight urethane modified alkyd resin (Desmalkyd® BAYER AG), 35% by weight longoil alkyd resin based on linseed oil having a low viscosity (Alkydal® L64 BAYER AG) and 5% by weight linseed oil. The microcapsule powder was substantially free from agglomerates and consisted of capsules having a mean diameter of 5 μm. The capsules were further characterised in that the walls consisted of a polyaddition product of the oxadiazine trione of hexamethylene diisocyanate and diethylene triamine. The capsules contained a 2.7% solution of crystal violet lactone in diisopropylnaphthalene. The core:wall ratio of the capsule was 85:15.

After the microcapsules had been stirred into the binder, 55 g of small cellulose fibres having a mean particle size of 50 μm were added. 85 g of printing oil (50 parts spindle oil, 50 parts linseed oil) were also added.

The mixture was ground 3 times on a three-roll mill. The printing ink thus prepared was applied by dry offset printing to a paper weighing 40 g/m$^2$ using an offset printing machine (Heidelberger Offsetdruckmaschinenfabrik, Format 64×46).

The weight of the coating amounted to 4.2 g/m$^2$. The paper was then placed with its printed side onto a standard CF-paper which had been coated with dye-developing substances. Under normal writing pressure, it was possible to obtain clearly legible copies on the CF-sheet.

In a test, another 7 untreated papers were placed on a combination of the printed CB-paper and a CF-paper and, using a typewriter adjusted to a constant striking pressure, the small letter "w" was typed on as closely as possible over a square area measuring 4×4 cm.

The eighth copy appearing on the CF-paper was tested for loss of reflection against untyped paper by means of a remission gauge (Zeiss Elrephomat) and the corresponding value determined.

The remission value is defined as follows:

$$\frac{I - I_o}{I} \times 100 = \text{remission value (\%)}$$

where

I=measured remission value $I_o$=remission value of the untyped paper.

A remission value of 17.9% was measured.

EXAMPLE 2

The procedure was as described in Example 1, except that the printing ink was applied to the paper in a weight of 9 g/m$^2$.

Remission measurement of the eighth copy by the method described in Example 1 produced a remission value of 33%.

EXAMPLE 3

A 30% aqueous microcapsule dispersion was produced, the walls of the microcapsules of which consisted of a polyaddition product of the oxadiazine trione of hexamethylene diisocyanate and a polyamine. The contents of the capsule was a solution of 2.7% of crystal violet lactone and 0.9% N-benzoylleucomethylene blue in diisopropyl diphenyl. The core/wall ratio of the microcapsules amounted to 83:17.

By spray-drying the 30% capsule dispersion was transferred in a capsule powder being substantially free from agglomerates. The medium diameter of the capsules was determined at 7.3 μm.

In a planetary mixer were introduced 300 g of a binder consisting of 25% by weight of urethane-modified alkyd resin (Desmalkyd® L 181 of Bayer AG) 40% by weight of a maleinic resin having an acid number of 15 (Alresat KM 224, Hoechst AG), 35% by weight of $C_{14}$–$C_{19}$ isoparaffin mixture and 125 g of the microcapsule powder produced added whilst stirring. 75 g of linseed-standoil were added. Thereafter 30 g of small cellulose fibres having a mean size of 20 μm was added.

The thus prepared mixture was ground three times by means of a three-roll mill and the thus pasted dye ventilated in a vacuum chamber. The thus produced printing ink, containing 23.5% by weight of microcapsules, was printed on the reverse side of a commercially used CF-paper (Giroset-CF of Feldmühle) over a square area of 5×5 cm in the wet offset method using a roller offset machine having a Dahlgren-Wetting Unit (Manufacturer: Müller Martini).

The weight of the coating amounted to 5.5 g and after drying a spot-wise coated, carbon-free copying paper was obtained.

When typewriting on several layers of these papers, produced a described above, a well-legible copy within the printed square was obtained.

EXAMPLE 4

The printing ink of Example 3 has been used.

The thus prepared ink was three times ground by means of a 3-roll mill and the thus pasted dye ventilated in a vacuum chamber. The printing ink containing 23.5% by weight of micro-capsules was then printed (using capital letter "W" in a size of 10 cm) with the aid of a book printing machine (Manufacturer: Heidelberger Maschinenfabrik) onto the reverse side of a commercially used CF-Paper (Giroset-CF of Feldmühle).

The weight of the coating amounted to 5.5 g/m$^2$ and, after drying, a spotwise coated, carbonless copying paper was obtained.

Upon typewriting on several layers of the papers thus produced, a well legible copy within the printed letter "W" was obtained.

EXAMPLE 5

The printing ink of Example 1 has been used.

The ink was five times ground using a 3-roll mill. The thus formulated printing ink was applied to a paper having a space weight of 40 g/m$^2$ by the technique of book printing using a printing machine (Manufacturer: Heidelberger Maschinenfabrik).

The weight of the coating amounted to 5.5 g/m$^2$. With the printed side the paper was then put onto a commercially used CF-Paper being coated with dye-developing substances.

Upon applying normal writing pressure well legible copies could be obtained.

We claim:

1. A process for producing a donor sheet for a pressure-sensitive carbonless copying system by applying printing ink containing a binder on to a paper substrate and then hardening the same, said process comprising applying a printing ink which comprises microcapsules containing a dye precursor, spacers having a grain size from 1.5 to 10 times the diameter of the microcapsules and a binder comprising an air-drying alkyd resin, a vegetable oil or a mixture thereof to at least part of a surface of a paper substrate by a wet or a dry offset or book printing technique.

2. The process of claim 1 wherein said binder includes a phenolic resin, a maleinic resin, one of said resins modified by rosin or a modified rosin.

3. The process of claim 1 wherein said binder includes a mineral oil.

4. The process of claim 1 wherein said binder includes a phenolic resin, a maleinic resin, one of said resins modified by rosin or a modified rosin and a mineral oil.

5. The process of claim 1 wherein said printing ink includes a siccative, an anti-skinning agent or a mixture thereof.

6. The process of claim 1 wherein said binder includes a phenolic resin, a maleinic resin, one of said resins modified by rosin or a modified rosin and said printing ink includes a siccative, an anti-skinning agent or a mixture thereof.

7. The process of claim 1 wherein said binder includes a phenolic resin, a maleinic resin, one of said resins modified by rosin or a modified rosin and a mineral oil and said printing ink includes a siccative, an anti-skinning agent or a mixture thereof.

8. A printing ink which comprises microcapsules containing a dye precursor, spacers having a grain size from 1.5 to 10 times the diameter of the microcapsules and a binder comprising an air-drying alkyd resin, vegetable oil or a mixture thereof.

9. The printing ink of claim 8 wherein said binder includes a phenolic resin, a maleinic resin, one of said resins modified by rosin or a modified rosin.

10. The printing ink of claim 8 wherein said binder includes a phenolic resin, a maleinic resin, one of said resins modified by rosin or a modified rosin and a mineral oil.

11. The printing ink of claim 8 containing a siccative, an anti-skinning agent or a mixture thereof.

12. The printing ink of claim 9 containing a siccative, an anti-skinning agent or a mixture thereof.

13. The printing ink of claim 10 containing a siccative, an anti-skinning agent or a mixture thereof.

14. The printing ink of claim 8 containing 80 to 40% by weight of a binder, 18 to 40% by weight of microcapsules and 2 to 20% by weight of spacers.

15. The printing ink of claim 8 having a viscosity of from 5 to 200 Pascal.

16. A donor sheet for a pressure-sensitive carbonless copying system produced by the process of claim 1.

* * * * *